US009653843B2

(12) United States Patent
Suzuki et al.

(10) Patent No.: US 9,653,843 B2
(45) Date of Patent: May 16, 2017

(54) CONNECTOR

(71) Applicant: YAZAKI CORPORATION, Tokyo (JP)

(72) Inventors: Toru Suzuki, Shizuoka (JP); Satoshi Nakai, Shizuoka (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 15/135,965

(22) Filed: Apr. 22, 2016

(65) Prior Publication Data

US 2016/0240960 A1 Aug. 18, 2016

Related U.S. Application Data

(63) Continuation of application No. PCT/JP2013/079567, filed on Oct. 31, 2013.

(51) Int. Cl.

| | |
|---|---|
| ***H01R 13/58*** | (2006.01) |
| ***H01R 13/506*** | (2006.01) |
| ***H01R 13/52*** | (2006.01) |
| *H01R 103/00* | (2006.01) |
| *H01R 13/631* | (2006.01) |

(52) U.S. Cl.

CPC ..... *H01R 13/58* (2013.01); *H01R 13/506* (2013.01); *H01R 13/5221* (2013.01); *H01R 13/5845* (2013.01); *H01R 13/6315* (2013.01); *H01R 2103/00* (2013.01); *H01R 2201/26* (2013.01)

(58) Field of Classification Search

CPC ..... H01R 13/5221; H01R 13/5845; H01R 13/506; H01R 13/58

See application file for complete search history.

(56) References Cited

U.S. PATENT DOCUMENTS

| | | | | |
|---|---|---|---|---|
| 2004/0166744 | A1 | 8/2004 | Inaba et al. | |
| 2012/0094539 | A1 | 4/2012 | Ooki | |
| 2014/0120763 | A1* | 5/2014 | Itsuki | H01R 13/5825 439/382 |

FOREIGN PATENT DOCUMENTS

| | | | |
|---|---|---|---|
| JP | 56-37310 | U | 4/1981 |
| JP | 8-45627 | A | 2/1996 |
| JP | 2004-253163 | A | 9/2004 |
| JP | 2008-152990 | A | 7/2008 |

(Continued)

OTHER PUBLICATIONS

Notification of Reasons for Refusal of Japanese Patent Application No. 2012-104753, dated Dec. 21, 2015.

(Continued)

*Primary Examiner* — Briggitte R Hammond
(74) *Attorney, Agent, or Firm* — Sughrue Mion, PLLC

(57) ABSTRACT

A connector includes: a plate-like terminal which is connected to an end of an electric wire; a rear connector in which the plate-like connector is accommodated; and a front connector in which a box-shaped female terminal that is connected to the plate-like terminal by being assembled to the rear connector and that is to be connected to a counterpart terminal of the electric device side is received. The plate-like terminal and the female terminal are connected by a connection terminal composed of a soft material capable of absorbing both positional displacement between the plate-like terminal and the female terminal and vibration of the plate-like terminal.

6 Claims, 9 Drawing Sheets

(56) References Cited

FOREIGN PATENT DOCUMENTS

| | | | | |
|---|---|---|---|---|
| JP | 2008-269858 | A | 11/2008 | |
| JP | 2010-225488 | A | 10/2010 | |
| JP | 2011-14422 | A | 1/2011 | |
| JP | 2011-34935 | A | 2/2011 | |
| JP | 2013-122869 | A | 6/2013 | |
| JP | 2013-232371 | A | 11/2013 | |
| JP | DE 102013017108 | A1 * | 5/2014 | ..... H01R 13/512 |
| WO | 2011/019026 | A1 | 2/2011 | |

OTHER PUBLICATIONS

International Search Report of PCT/JP2013/079567, dated Feb. 4, 2014. [PCT/ISA/210].
Written Opinion of PCT/JP2013/079567, dated Feb. 4, 2014. [PCT/ISA/237].

* cited by examiner

CONNECTOR

CROSS REFERENCE TO RELATED APPLICATIONS

This application is a continuation of International Application No. PCT/JP2013/079567, filed Oct. 31, 2013, the entire contents of which are incorporated herein by reference.

TECHNICAL FIELD

The present application relates to a connector used in an automobile or the like.

BACKGROUND

In a connector used in an automobile or the like, a structure in which a relay terminal is attached to an electric wire that supplies an electric current to a load side, and through the relay terminal a female terminal to be connected to a power supply is connected is used. Moreover, while the relay terminal is accommodated in a rear connector, the female terminal is accommodated in a front connector, and it is made as a connector by assembling the front connector to the rear connector (see JP 2004-253163 A (PTL 1)). By bringing a counterpart terminal of a counterpart connector into contact with the female terminal by fitting the counterpart connector to the front connector of this connector, electrical conduction between the mutual connectors is made.

SUMMARY

However, when the front connector and the rear connector are assembled in a state that there is a tolerance between the front connector and the rear connector, since the position of the female terminal relative to the counterpart terminal of the counter connector is shifted, inconvenience of the female terminal not being brought into contact with the counterpart terminal occurs. Particularly, with the rear connector formed by molding, since the relay terminal is buried in the rear connector and does not move, noncontact due to positional displacement of the female terminal tends to occur easily.

Moreover, in an automobile, vibration during traveling is transferred to the electric wire, and that is transferred to the female terminal via the relay terminal, by which the female terminal vibrates. Due to this vibration, the female terminal and the counterpart terminal rub against each other to generate an electric current that becomes hindrance in transferring an original electric current.

For the above reasons, in a connector, it is desirable that the tolerance is absorbed and vibration from the electric wire does not become transferred to the female terminal.

Thus, the present application aims to provide a connector which can absorb the tolerance and in which vibration does not become transferred to the female terminal.

A first aspect of the present application is a connector that connects an electric device for electric power control and an end of an electric wire The connector includes: a rear connector including a plate-like terminal connected to the end of the electric wire and a rear housing in which the plate-like terminal is accommodated; a front connector including a front housing in which a box-shaped female terminal that is connected to the plate-like terminal by being assembled to the rear connector and that is to be connected to a counterpart terminal of the electric device side is received; and a connection terminal that connects the plate-like terminal and the female terminal, the connection terminal being made of a soft material capable of absorbing positional shift between the plate-like terminal and the female terminal and vibration of the plate-like terminal.

Since the plate-like terminal and the female terminal are connected by the connection terminal made of a soft material capable of absorbing positional shift between the plate-like terminal and the female terminal and vibration of the plate-like terminal, even if there is a tolerance between the rear connector and the front connector, the positional shift between the plate-like terminal and the female terminal according to the tolerance can be absorbed, and the female terminal can be fixed at a fixed position of the front connector. Thus, it is possible to favorably bring the female terminal into contact with the counterpart terminal. Accordingly, it is possible to smoothly assemble the front connector to the rear connector.

Moreover, in a case that the plate-like terminal vibrates due to vibration from the electric wire, such vibration is not transferred to the female terminal because the connection terminal made of a soft material absorbs this vibration. Thus, it is possible to prevent that the vibration is transferred between the female terminal and the counterpart terminal of the counterpart connector on the electric device side. Accordingly, connection between the female terminal and the counterpart terminal can be made reliably.

It is preferable that a molded waterproof part that prevents water intrusion from a periphery of the electric wire is integrally molded at least around the periphery of the electric wire, and the electric wire that includes the molded waterproof part is integrally molded with the rear housing.

By integrally molding the molded waterproof part around the end of the electric wire, and integrally molding the electric wire that includes the molded waterproof part to the rear housing thereby forming a waterproof structure, the number of component parts for waterproofing is not increased and the connector does not become large. In addition, since the molded waterproof part is integrally molded to the electric wire and the rear housing is integrally molded, the assembly process is decreased and the manufacturing becomes easy.

It is preferable that a regulating engagement part that regulates relative movement with respect to the rear housing is formed on the molded waterproof part.

Since the regulating engagement part that regulates relative movement with respect to the rear housing is formed on the molded waterproof part, displacement of the molded waterproof part at the time of pressure-holding or cooling of the rear housing molding can be prevented. Thus, since relative movement of the molded waterproof part with respect to the rear housing can be regulated and the molded waterproof part will not shift from a fixed position of the electric wire, decrease in the waterproof property can be prevented.

It is preferable that the connection terminal is composed of a braided wire.

By using the braided wire as the connection terminal, favorable softness can be given to the connection terminal.

DESCRIPTION OF EMBODIMENTS

Figure 1:
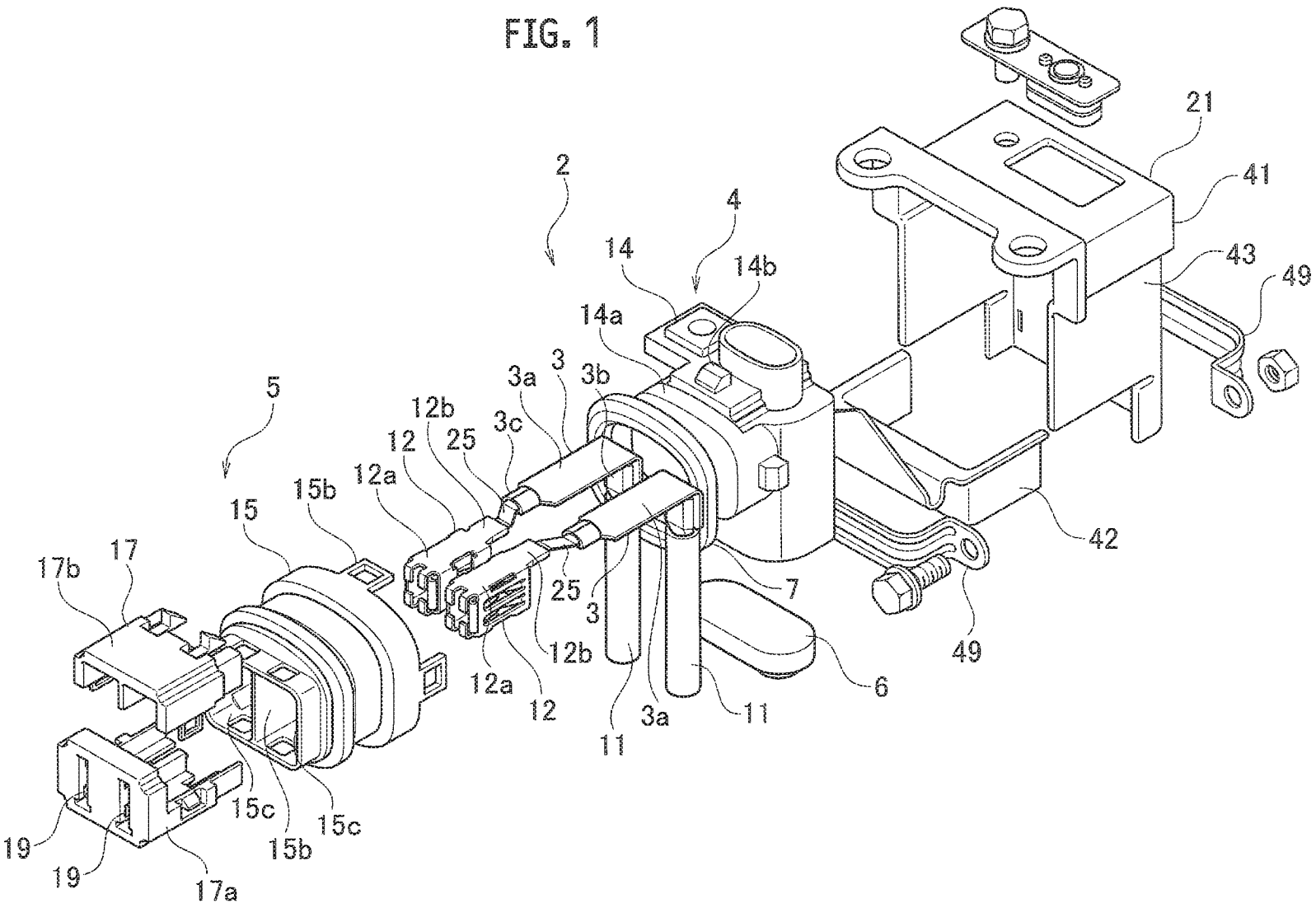
FIG. 1 is an exploded perspective view illustrating a connector according to a first embodiment.

Hereinafter, embodiments of the present application will be explained based on the drawings. Moreover, in each embodiment, the same symbol is affixed to the same member to correspond.

[First Embodiment]

FIGS. 1 to 4 illustrate a connector 2 according to a first embodiment. The connector 2 connects an electric device (not illustrated) for electric power control and electric wires 11. The connector 2 is formed by including plate-like terminals 3, a rear connector 4, a front connector 5, female terminals 12, and a molded waterproof part 6.

Figure 2:
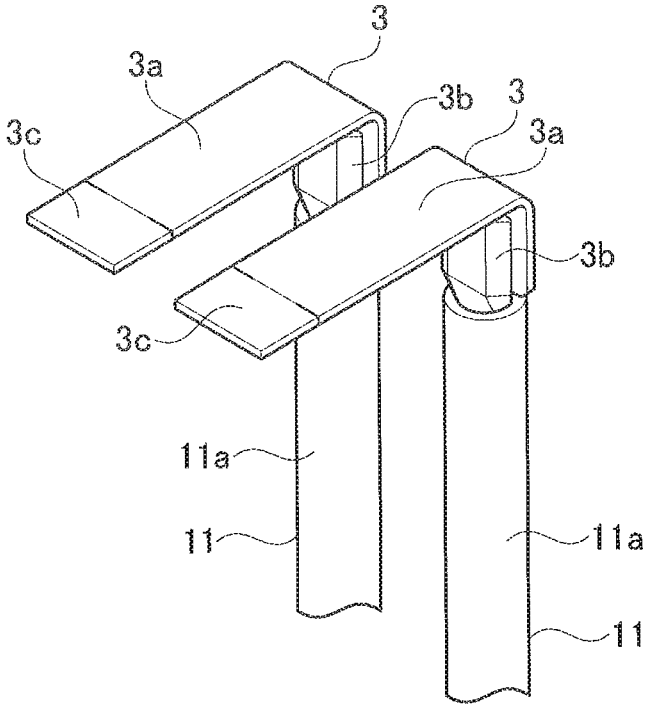
FIG. 2 is a perspective view illustrating an electric wire before a molded waterproof part is integrally molded.

The plate-like terminals 3 are connected to ends of the electric wires 11 from a power source. In the first embodiment, the electric wires 11 are formed with two core wires, and each of the plate-like terminals 3 is connected to an end of the respective electric wire 11. As illustrated in FIG. 2, each of the plate-like terminal 3 is formed with a plate-like terminal body 3*a*; an electric wire side connection part 3*b* that is bent into a right angle shape from the terminal body 3*a* and is connected to an end of an internal conductor of the electric wire 11 by crimping; and a female terminal side connection part 3*c* that is integrally formed with an end of the terminal body 3*a* at the opposite side from the electric wire side connection part 3*b* and to which a connection terminal 25 from the female terminal 12 is connected by crimping or welding.

The rear connector 4 has a rear housing 14, and the plate-like terminals 3 and the ends of the electric wires 11 connected to the plate-like terminals 3 are accommodated inside the rear housing 14. The rear housing 14 is formed with insulating resin such as polybutylene terephthalate (PBT) or the like. At the rear housing 14, an attachment portion 14*a* having an oblongly cylindrical shape to which the front connector 5 can be attached is integrally provided on its front face side. On the exterior of the attachment portion 14*a*, a locking protrusion 14*b* for assembly with the front connector 5 is formed. The rear housing 14 is not something that is molded in advance, but it is integrally molded inside a mold die together with the molded waterproof part 6 at the time of manufacturing of the connector 2.

The integrally-molded rear housing 14 is accommodated in a shield shell 21. The shield shell 21 is formed into a box shape by metal such as aluminum or the like, and provides electromagnetic wave shielding for the accommodated rear connector 4. The shield shell 21 includes an upper shell 41 and an under shell 42, and is formed by the upper shell 41 and the under shell 42 assembled by a holding bracket 49. The upper shell 41 includes an outer periphery shield wall 43 that covers the outer periphery of the rear connector 4. By accommodating the rear connector 4 inside the shield shell 21, electromagnetic wave shielding from outside is provided.

The front connector 5 includes a front housing body 15 (front housing) and a front part 17.

The front housing body 15 accommodates the pair of female terminals 12. Each of the female terminals 12 is formed into a box shape, and is accommodated in the front housing body 15 in a state that it is connected to the respective plate-like terminal 3. Terminal housing chambers 15*c* are formed in the front housing body 15 in order to accommodate the female terminals 12. The terminal housing chambers 15*c* are divided by a partition wall 15*a* to prevent mutual contact of the female terminals 12 inserted in the respective terminal housing chambers 15*c*. The front housing body 15 is assembled to the attachment portion 14*a* of the rear housing 14, and a hook portion 15*b* that corresponds to the locking protrusion 14*b* of the attachment portion 14*a* protrudes toward the rear housing 14. A seal ring 7 composed of rubber or the like is inserted between the front housing body 15 and the rear connector 4.

Figure 5:
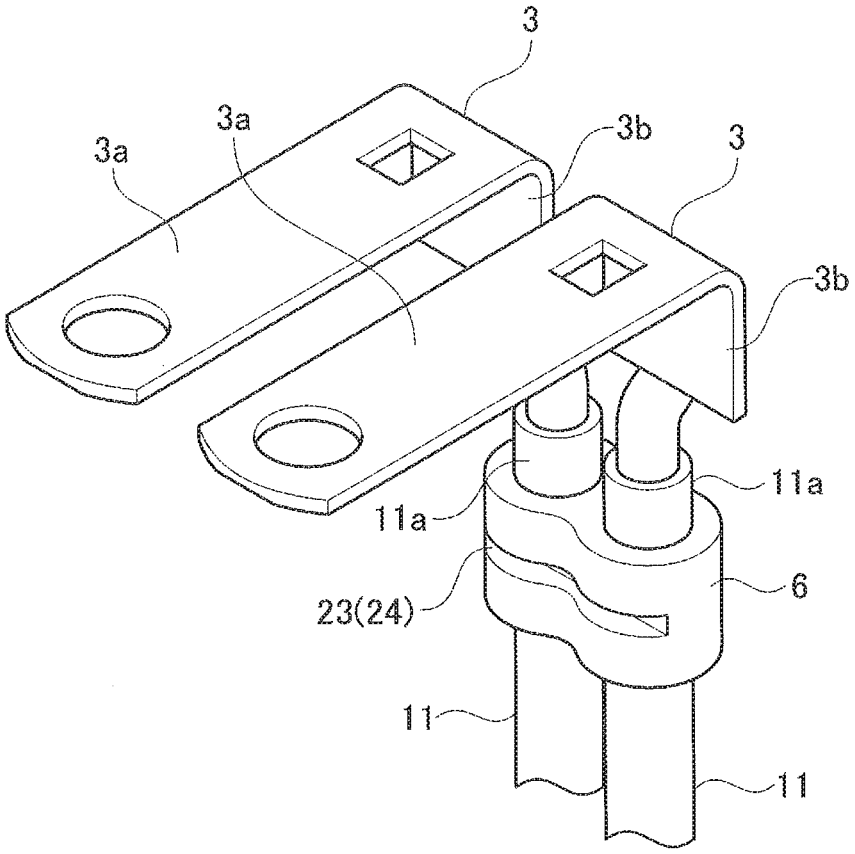
FIG. 5 is a perspective view of an electric wire in a second embodiment.

Counterpart terminals of an electric device for electric power control can be inserted into the front part 17. As illustrated in FIG. 5, the front part 17 includes a lower front part 17*a* and an upper front part 17*b*, which can be mutually assembled. Rectangular-shaped counterpart terminal slots 19 to which the plate-like counterpart terminals (not illustrated) from the electric device for electric power control side can be inserted are formed on the lower front part 17*a*. The counterpart terminals inserted into the counterpart terminal slots 19 are electrically connected to the box-shaped female terminals 12 accommodated inside the terminal housing chambers 15*c* of the front housing body 15.

Each of the female terminals 12 includes a box-shaped female box connection part 12*a* and a sheet-shaped plate-like connection part 12*b* that extends from the female box connection part 12*a*. A female terminal side end 25*a* of the connection terminal 25 (see FIGS. 3 and 4) is connected to the plate-like connection part 12*b* by welding. The other end of the connection terminal 25 becomes a plate-like terminal side end 25*b* (see FIGS. 3 and 4). The female terminal 12 and the plate-like terminal 3 are connected via the connection terminal 25 by crimping the female terminal side connection part 3*c* of the plate-like terminal 3 to the plate-like terminal side end 25*b*.

Figure 11:
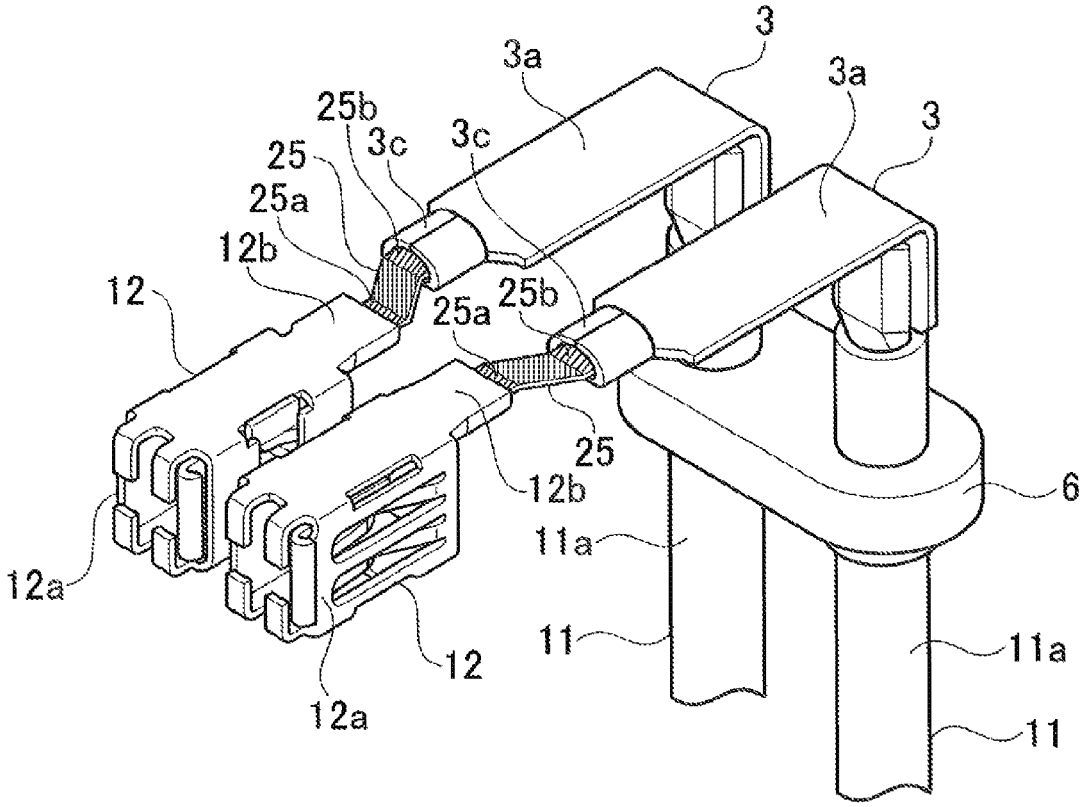
FIG. 11 is a perspective view illustrating a state in which a plate-like terminal and a female terminal are connected via a braided wire connection terminal.

The connection terminal 25 is formed in a thin belt-like shape with a soft material, and one end thereof in the longitudinal direction becomes the female terminal side end 25*a* which is connected to the female terminal 12, and the other end becomes the plate-like terminal side end 25*b* which is connected to the plate-like terminal 3. As the soft material, one that has a property which can absorb positional shift between the plate-like terminal 3 and the female terminal 12, and which can absorb vibration of the plate-like terminal 3 transferred from the electric wire 11 is used. In the first embodiment, a braided wire is used as the connection terminal 25 as shown in FIG. 11. By using the braided wire, favorable softness can be given to the connection terminal 25.

By connecting the plate-like terminal 3 and the female terminal 12 with the connection terminal 25 made of a soft material, even if there is a manufacturing tolerance between the rear connector 4 and the front connector 5, the tolerance can be absorbed since the female terminal 12 and the plate-like terminal 3 relatively shift with each other according to this tolerance when the front connector 5 is assembled to the rear connector 4. Thus, it is possible to smoothly assemble the front connector 5 to the rear connector 4. Moreover, in a case that the plate-like terminal 3 vibrates due to vibration from the electric wire 11, such vibration is not transferred to the female terminal 12 because the connection terminal 25 made of a soft material absorbs such vibration. Accordingly, it is possible to securely connect the female terminal 12 and a counterpart terminal without positional displacement between the counterpart terminal of the counterpart connector on the electric device side and the female terminal 12.

The molded waterproof part 6 is integrally molded around the electric wire 11. The molded waterproof part 6 is provided to surround the periphery of the electric wires 11 composed of two core wires, and blocks water that moves through an insulating outer envelope 11*a* of the electric wire 11 toward the plate-like terminal 3. Thus, water intrusion from the periphery of the electric wire 11 can be prevented.

The molded waterproof part 6 is not something that is molded in advance, but is integrally molded inside a mold die at the time of manufacturing the connector 2. FIG. 1 illustrates a shape of the molded waterproof part which is molded by integral molding. Since the molded waterproof part 6 becomes integral with the electric wires 11 by being integrally molded as such, it is rigidly combined with the electric wires 11 as compared with a case in which a seal ring such as rubber is simply wrapped around the electric wires 11. Thus, the waterproof property is remarkably improved.

As a material for the molded waterproof part 6, thermosetting elastomer is used. As the thermosetting elastomer, vulcanized rubber or thermosetting resin elastomer can be used. As the thermosetting resin elastomer, urethane rubber, silicone rubber, fluorocarbon rubber, or the like can be arbitrarily selected.

Next, a manufacturing method of the connector 2 according to the first embodiment will be explained based on FIGS. 2 to 4. FIG. 2 illustrates a state before the integral molding of the molded waterproof part 6, and the plate-like terminals 3 are connected to respective ends of the electric wires 11 composed of two core wires.

Figure 3:
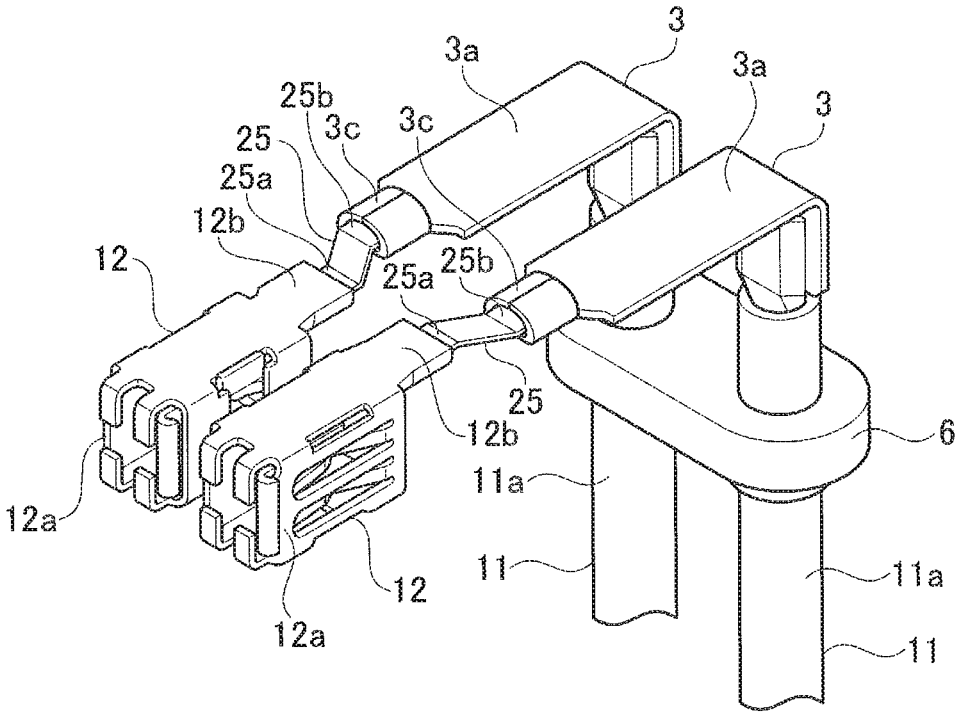
FIG. 3 is a perspective view illustrating a state in which a plate-like terminal and a female terminal are connected via a connection terminal.

FIG. 3 illustrates a state after the integral molding of the molded waterproof part 6. The ends of the electric wires 11 to which the plate-like terminals 3 have been attached are set inside a mold die, and thermosetting elastomer is injected inside the mold die and heat-cured. Thus, the molded waterproof part 6 is integrally molded around the ends of the electric wire 11.

After the integral molding of the molded waterproof part 6, the box-shaped female terminals 12 are connected to the respective plate-like terminals 3. This connection is made by welding the female terminal side end 25*a* of the connection terminal 25 to the plate-like connection part 12*b* of the female terminal 12, and bringing the plate-like terminal side end 25*b* of the connection terminal 25 into contact with the female terminal side connection part 3*c* of the plate-like terminal 3 and crimping the female terminal side connection part 3*c*. Thus, the plate-like terminal 3 and the female terminal 12 are connected via the connection terminal 25. Since the connection terminal 25 is made of a soft material, in the connected state, the plate-like terminal 3 and the female terminal 12 are capable of mutual displacement.

Figure 4:
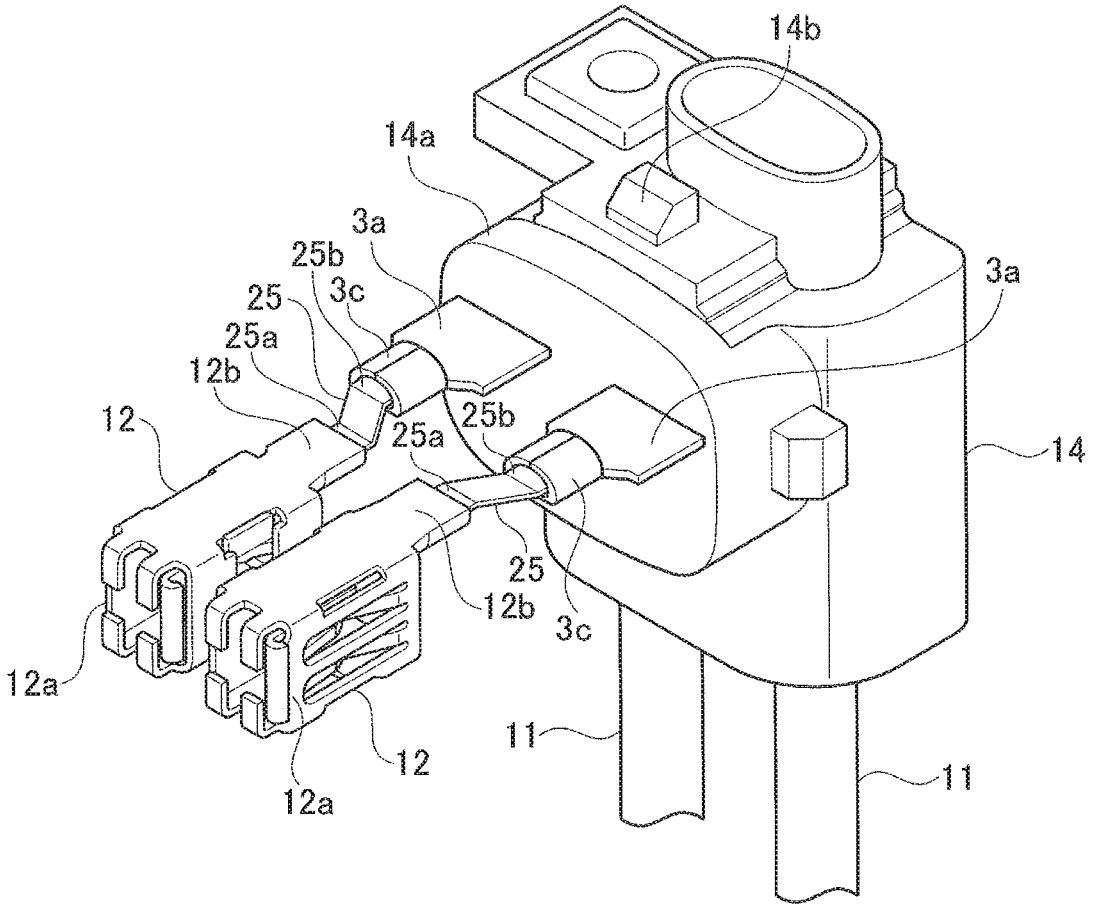
FIG. 4 is a perspective view illustrating a state in which a rear housing is molded in a state that the molded waterproof part has been formed.

FIG. 4 illustrates a state in which the rear housing 14 is integrally molded. The integral molding as illustrated in FIG. 4 is performed after the integral molding of the molded waterproof part 6 to the ends of the electric wires 11 and the connection of the plate-like terminals 3 to the female terminals 12 by welding.

Integral welding of the rear housing 14 is performed by setting the ends of the electric wires 11 on which the molded waterproof part 6 is formed and the plate-like terminals 3 connected to the ends of the electric wires 11 inside a mold die, and injecting insulating resin inside the mold die and cure. By this molding, the molded waterproof part 6 and the ends of the electric wires 11 on which the molded waterproof part 6 is provided become a state of being buried in the rear housing 14. Accordingly, the molded waterproof part 6 becomes in a state of being fixed inside the rear housing 14, and the molded waterproof part 6 is inhibited from separating from the electric wires 11. Thus, since it is possible to maintain the state that the molded waterproof part 6 closely contacts the periphery of each of the electric wires 11, water intrusion can be reliably prevented by the molded waterproof part 6.

After the molded waterproof part 6 has been integrally molded to the ends of the electric wires 11 and the rear housing 14 has been integrally molded to the molded waterproof part 6, the front housing body 15 is assembled to the rear housing 14. In this case, by assembling the front part 17 and inserting into the front housing body 15, the front connector 5 is formed.

Thereafter, the front housing body 15 is assembled to the attachment portion 14*a* of the rear housing 14 while inserting the female terminals 12 into the terminal housing chambers 15*c* of the front housing body 15. In this assembly, since the female terminals 12 are connected to the respective plate-like terminals 3 via the connection terminal 25 made of a soft material, it is possible to easily insert the female terminals 12 into the terminal housing chambers 15*c* of the front housing body 15.

In the first embodiment, the molded waterproof part 6 is integrally molded around the ends of the electric wires 11, and the electric wires 11 that include the molded waterproof part 6 are integrally molded to the rear housing 14 thereby forming a waterproof structure. Thus, the number of component parts for waterproofing is not increased and the connector 2 does not become large. In addition, since the molded waterproof part 6 is integrally molded to the electric wires 11 and the rear housing 14 is integrally molded, the assembly process is decreased and the manufacturing becomes easy.

In the first embodiment, the plate-like terminal 3 and the female terminal 12 are connected by the connection terminal 25 made of a soft material. Thus, even if there is a tolerance between the rear connector 4 and the front connector 5, positional shift of the female terminal 12 and the plate-like terminal 3 according to the tolerance can be absorbed and it is possible to fix the female terminal 12 at a fixed position of the front connector 5. Thus, it is possible to favorably bring the female terminal 12 into contact with the counterpart terminal. Accordingly, assembly of the front connector 5 and the rear connector 4 can be performed smoothly. Moreover, in a case that the plate-like terminals 3 vibrate due to vibration from the electric wires 11, since each of the connection terminals 25 made of a soft material absorbs this vibration, the vibration is not transferred to the female terminals 12. Thus, it is possible to prevent that the vibration is transferred between the female terminals 12 and the counterpart terminals of the counterpart connector on the electric device side, and connection between the female terminals and the counterpart terminals can be made reliably.

[Second Embodiment]

Figure 6:
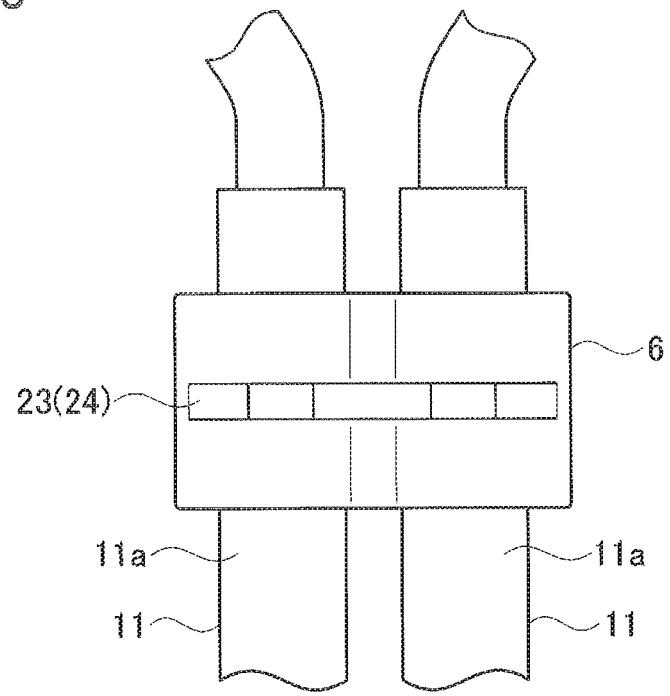
FIG. 6 is a front view of FIG. 5.
Figure 7:
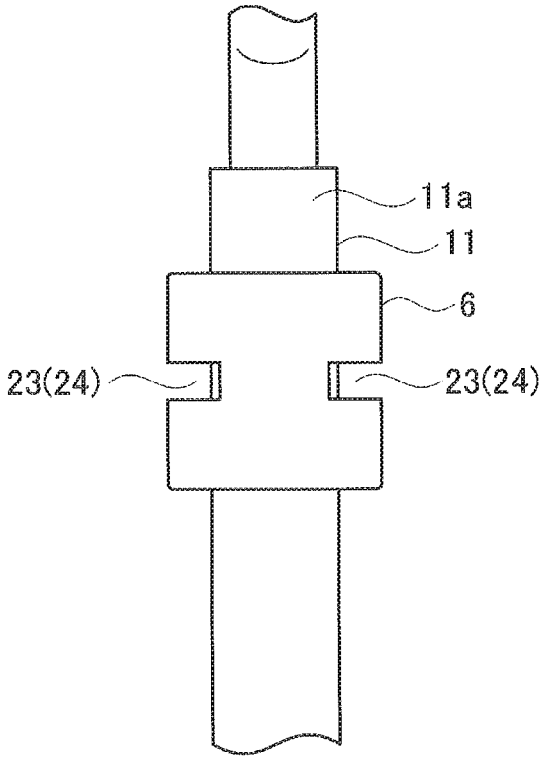
FIG. 7 is a side view of FIG. 5.

FIGS. 5 to 7 illustrate a second embodiment. In the second embodiment, a regulating engagement part 23 is formed on the molded waterproof part 6 that is integrally molded around the ends of the electric wires 11. The regulating engagement part 23 is composed of engagement grooves 24 each formed in a recessed shape on the outer face of the molded waterproof part 6.

The engagement grooves 24 as the regulating engagement part 23 are formed in a direction that intersects the longitudinal direction of the electric wires 11. In the second embodiment, the engagement grooves 24 are formed on the outer face of the molded waterproof part 6 so as to be orthogonal with the lengthwise direction of the electric wires 11. The engagement grooves 24 are formed in the middle section in the lengthwise direction of the molded waterproof part 6 (the vertical direction in FIGS. 5 to 7), and the molded waterproof part 6 is in a state of putting the engagement grooves 24 therebetween. Each of the engagement grooves 24 is formed in a depth that reaches the insulating outer envelopes 11*a* of the electric wires 11.

When the rear housing 14 is integrally molded with the molded waterproof part 6 to which the engagement grooves 24 as the regulating engagement part 23 are formed, it is possible to prevent displacement of the molded waterproof part 6 at the time of pressure-holding or cooling of the rear housing 14 molding.

In other words, since the elastomer (thermosetting elastomer) of the molded waterproof part 6 and the resin of the rear housing 14 are different materials and coefficients of thermal expansion differ, contraction coefficients at the time of molding the rear housing 14 differ. Since internal stress is acted upon in the molded waterproof part 6 due to this difference in the contraction coefficients, there is a case that the molded waterproof part 6 is shifted with respect to the electric wires 11 at the time of integral molding of the rear housing 14. When such displacement of the molded waterproof part 6 occurs, the waterproof property is deteriorated. On the other hand, in a case that the engagement grooves 24 are formed on the molded waterproof part 6 as in the second embodiment, since the resin that forms the rear housing 14 enters into the engagement grooves 24 and is cured in a state that the resin is entered, the molded waterproof part 6 becomes in a state of being fixed in a fixed position. Thus, relative movement of the molded waterproof part 6 with respect to the rear housing 14 is regulated and the molded waterproof part 6 does not shift from the fixed position of the electric wires 11. Thus, it is possible to prevent deterioration of the waterproof property.

Further, as the regulating engagement part 23, a protrusion may be formed on the molded waterproof part 6 instead of the groove.

[Third Embodiment]

Figure 8:
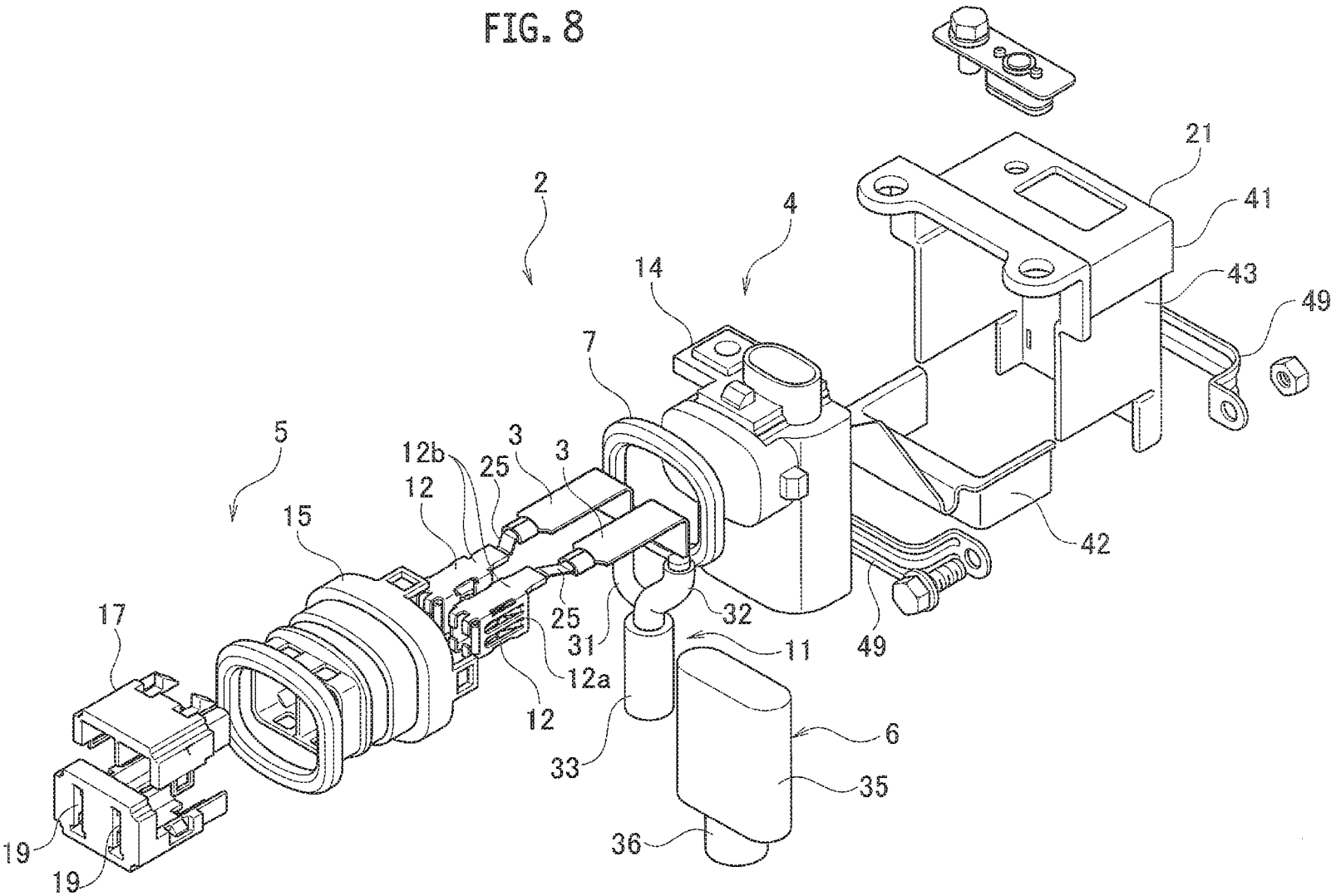
FIG. 8 is an exploded perspective view illustrating a connector according to a third embodiment.

FIG. 8 illustrates a connector 2 according to a third embodiment.

In the connector 2 according to the third embodiment, a coaxial cable is used as an electric wire 11. The electric wire 11 composed of the coaxial cable is formed with an inner conductor 31, an outer conductor 32 arranged around the inner conductor 31 via an insulating inner coating, and an insulating outer envelope 33 coated around the outer conductor 32. With the electric wire 11, the inner conductor 31 and the outer conductor 32 are pulled out by stripping, and the plate-like terminals 3 are connected to the ends of the inner conductor 31 and the outer conductor 32 respectively.

Then, the molded waterproof part 6 is integrally molded to a portion that includes the ends of the inner conductor 31 and the outer conductor 32. Since the inner conductor 31 and the outer conductor 32 are pulled out in directions that are mutually separating from each other, the molded waterproof part 6 is molded in a shape in which a conductor covering part 35 that surrounds the periphery of these and an end covering part 36 that surrounds the periphery of the pulled-out portions (the ends) of the inner conductor 31 and the outer conductor 32 of the electric wire 11 are integrally formed.

The molded waterproof part 6 is formed by integral molding in which thermosetting elastomer is injected in a state that the inner conductor 31 and the outer conductor 32, the pulled-out portions (the ends) of these, and the plate-like terminals 3 are set inside a mold die and cured. After the molded waterproof part 6 is molded, similarly to the first embodiment, the rear housing 14 is integrally molded to the portion that includes the molded waterproof part 6 at the electric wire 11.

In the third embodiment, since the molded waterproof part 6 is integrally molded around the end of the electric wire 11 composed of the coaxial cable, the molded waterproof part 6 is rigidly combined with the electric wire 11 in a closely contacted integral state. Thus, water intrusion can be reliably prevented by the molded waterproof part 6 blocking water that moves through the electric wire 11. Moreover, since the electric wire 11 that includes the molded waterproof part 6 is integrally molded with the rear housing 14, the molded waterproof part 6 is buried integrally with the rear housing 14, and the state that the molded waterproof part 6 is closely contacted with the electric wire 11 can be maintained and water-intrusion prevention capability by the molded waterproof part 6 is increased.

In the third embodiment also, the plate-like terminals 3 and the female terminals 12 are connected by the respective connection terminals 25 each made of a soft material. Accordingly, even if there is a tolerance between the rear connector 4 and the front connector 5, positional shift of the female terminals 12 and the plate-like terminals 3 according to the tolerance can be absorbed and it is possible to fix the female terminals 12 at a fixed position of the front connector 5. Thus, it is possible to favorably bring the female terminals 12 into contact with the counterpart terminals, and assembly of the front connector 5 to the rear connector 4 can be performed smoothly. Moreover, in a case that the plate-like terminals 3 vibrate due to vibration from the electric wire 11, since the connection terminals 25 each made of a soft material absorb this vibration, the vibration is not transferred to the female terminals 12. Thus, it is possible to prevent that the vibration is transferred between the female terminals 12 and the counterpart terminals of the counterpart connector on the electric device side, and connection between the female terminal and the counterpart terminal can be made reliably.

Further, in the third embodiment also, the regulating engagement part 23 of the second embodiment may be formed on the molded waterproof part 6, and by doing so, displacement of the molded waterproof part 6 can be prevented and decrease in the waterproof property can be prevented.

Figure 9:
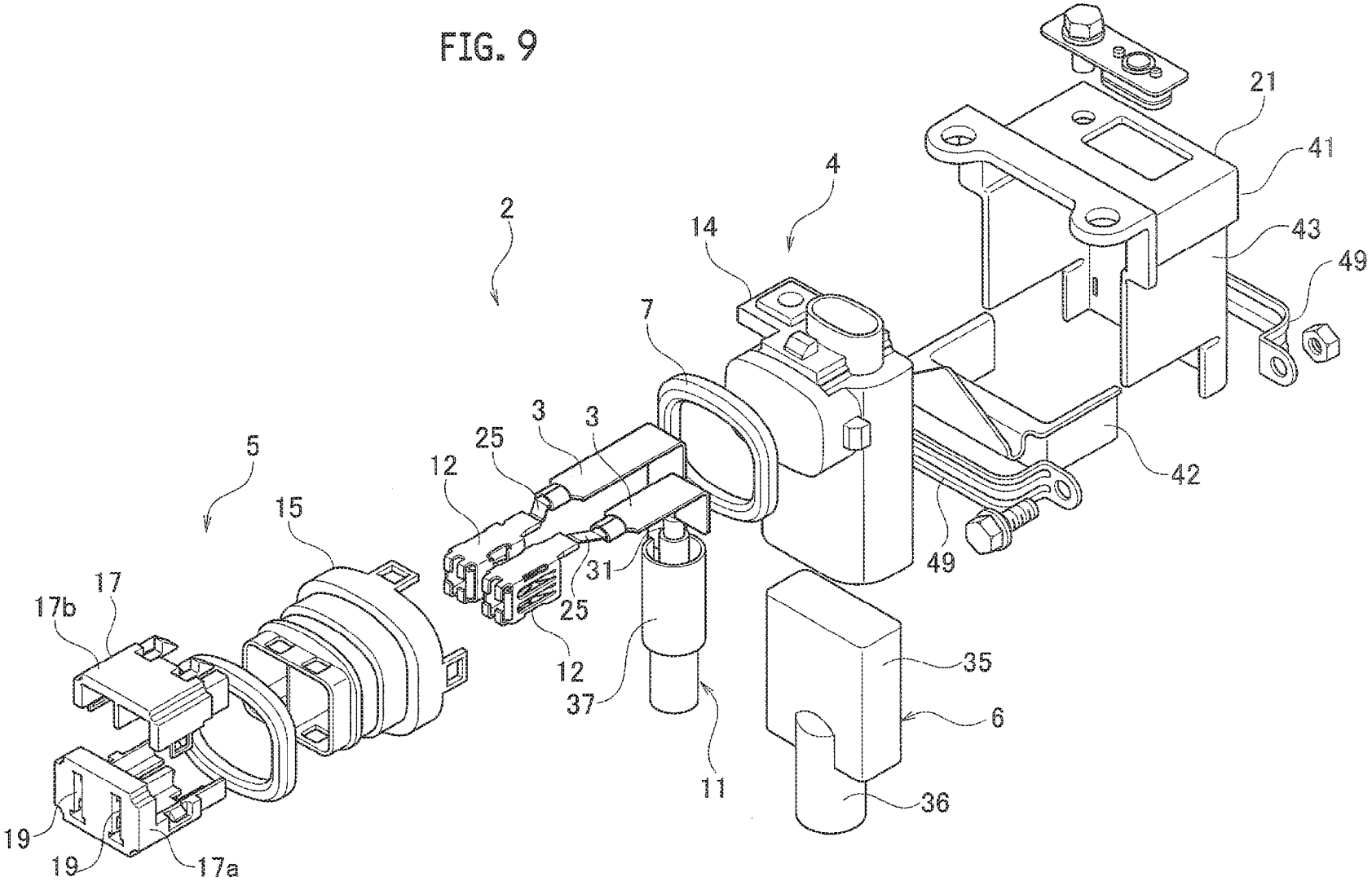
FIG. 9 is an exploded perspective view illustrating a connector according to a modification of the third embodiment.

FIG. 9 illustrates a modification in a case of using the coaxial cable as the electric wire 11. In FIG. 9, a cylindrical connection end 37 is integrally formed on the plate-like terminal 3 to be connected to the outer conductor 32. The cylindrical connection end 37 is externally inserted to the outer conductor 32 that has been stripped and exposed, and the cylindrical connection end 37 is connected to the outer conductor 32 by crimping or ultrasonic bonding. Thus, the inner conductor 31 and the outer conductor 32 are pulled out in generally the same direction. The molded waterproof part 6 that surrounds the periphery of the end of the electric wire 11 is formed to have a large diameter in which the end covering part 36 surrounds the cylindrical connection end 37.

[Fourth Embodiment]

Figure 10:
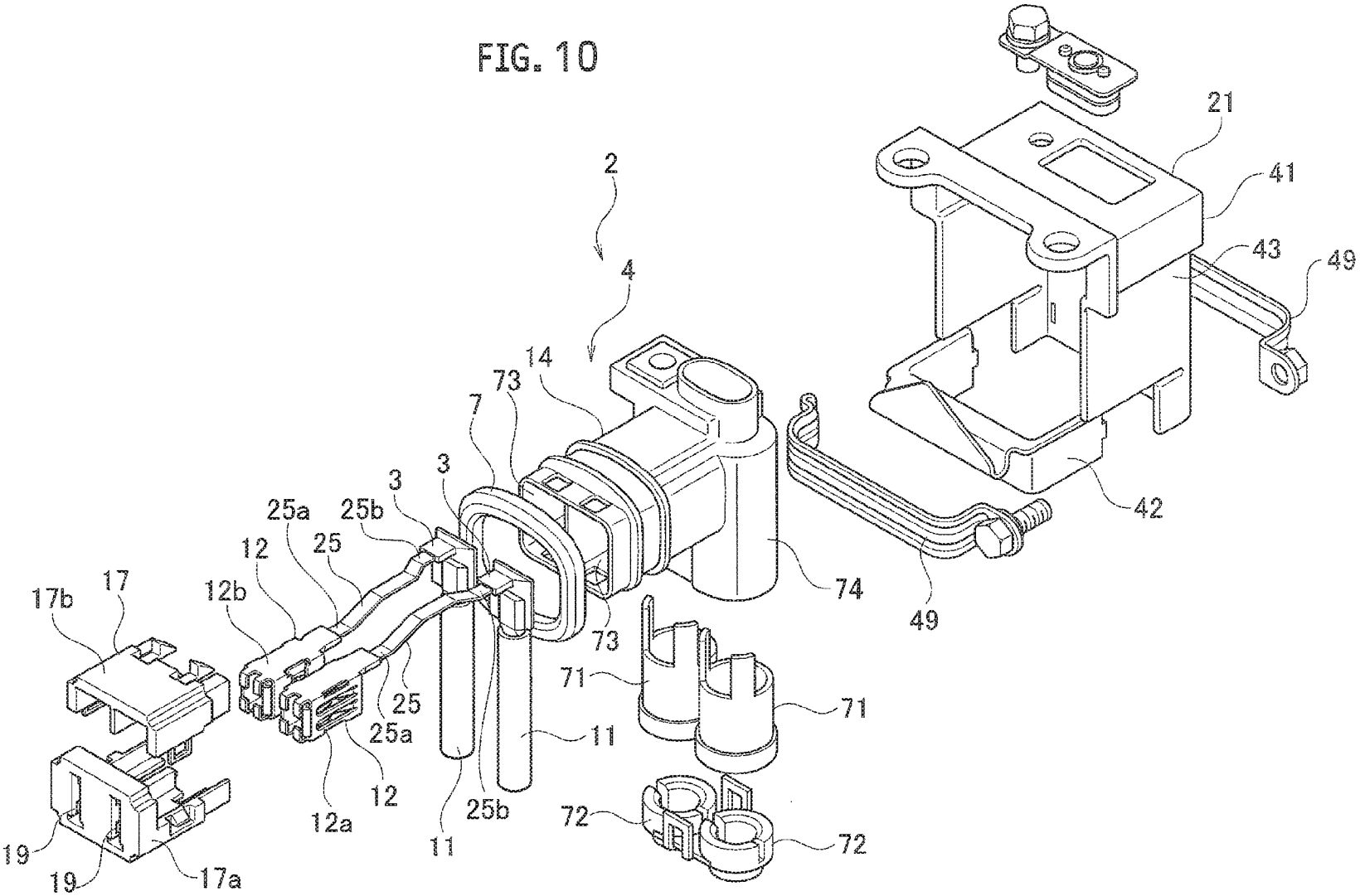
FIG. 10 is an exploded perspective view illustrating a connector according to a fourth embodiment.

FIG. 10 illustrates a connector 2 according to a third embodiment.

The connector 2 according to the fourth embodiment does not integrally mold the molded waterproof part 6, but molds the rear connector 4 in advance, and arrange the electric wires 11 and the plate-like terminals 3 inside the molded rear connector 4 in an assembled state. For the connector 2 according to the fourth embodiment, the electric wires 11 composed of two core wires is used.

An electric wire insertion cylinder 74 that accommodates the electric wires 11 and the plate-like terminals 3 connected to the ends of the electric wires 11 is formed in the rear housing 14 of the rear connector 4. Terminal housing chambers 73 for accommodating the female terminals 12 are formed in the rear housing 14. The terminal housing chambers 73 communicate with the counterpart terminal slots 19 of the front part 17.

On the outer peripheries of the electric wires 11, waterproof property is given by attaching waterproof plugs 72. Further, cylindrical shielding members 71 to which the waterproof plugs 72 and the ends of the electric wires 11 are inserted are used, and the shielding member 71 is inserted into the electric wire insertion cylinder 74 of the rear housing 14.

In the fourth embodiment also, the plate-like terminals 3 and the female terminals 12 are connected by the respective connection terminals 25 each made of a soft material. That is, the plate-like terminals 3 and the female terminals 12 are connected by welding the female terminal side ends 25*a* of the connection terminals 25 to the plate-like connection parts 12*b* of the female terminals 12, and crimping the plate-like terminal side ends 25*b* of the connection terminals 25 to the female terminal side connection parts 3*c* of the plate-like terminals 3. In this case, a relatively long belt shape is used for each of the connection terminals 25, and positional shift of the female terminals 12 with respect to the plate-like terminals 3 can be favorably absorbed.

In this manner, by the plate-like terminals 3 and the female terminals 12 being connected by the respective connection terminals 25 each made of a soft material, even if there is a tolerance between the rear connector 4 and the front connector 5, positional shift of the female terminals 12 and the plate-like terminals 3 according to the tolerance can be absorbed and it is possible to fix the female terminals 12 at a fixed position of the front connector 5. Thus, it is possible to favorably bring the female terminals 12 into contact with the counterpart terminals, and assembly of the front connector 5 and the rear connector 4 can be performed smoothly. Moreover, in a case that the plate-like terminals 3 vibrate due to vibration from the electric wires 11, since the connection terminals 25 each made of a soft material absorb this vibration, the vibration is not transferred to the female terminals 12. Thus, it is possible to prevent that the vibration is transferred between the female terminals 12 and the counterpart terminals of the counterpart connector on the electric device side, and connection between the female terminals and the counterpart terminals can be made reliably.

What is claimed is:

1. An electrical connector that connects an electric device for electric power control and an end of an electric wire, comprising:

a rear connector including a plate-like terminal connected to the end of the electric wire, and a rear housing in which the plate-like terminal is accommodated;

a front connector including a front housing in which a box-shaped female terminal that is connected to the plate-like terminal by being assembled to the rear connector and that is to be connected to a counterpart terminal of the electric device side is received; and a connection terminal that connects the plate-like terminal and the female terminal, the connection terminal being made of a soft material capable of absorbing positional shift between the plate-like terminal and the female terminal and vibration of the plate-like terminal, wherein the connection terminal is a separate and distinct component of the electrical connector relative to the electric wire, the plate-like terminal, and the female terminal.

2. The electrical connector of claim 1, wherein:

a molded waterproof part that prevents water intrusion from a periphery of the electric wire is integrally molded at least around the periphery of the electric wire, and the electric wire that includes the molded waterproof part is integrally molded with the rear housing.

3. The electrical connector of claim 2, wherein a regulating engagement part that regulates relative movement with respect to the rear housing is formed on the molded waterproof part.

4. The electrical connector of claim 1, wherein the connection terminal comprises a braided wire.

5. An electrical connector that connects an electric device for electric power control and an end of an electric wire, comprising:

a rear connector including a plate-like terminal connected to the end of the electric wire, and a rear housing in which the plate-like terminal is accommodated;

a front connector including a front housing in which a box-shaped female terminal that is connected to the plate-like terminal by being assembled to the rear connector and that is to be connected to a counterpart terminal of the electric device side is received; and a connection terminal that connects the plate-like terminal and the female terminal, the connection terminal being made of a soft material capable of absorbing positional shift between the plate-like terminal and the female terminal and vibration of the plate-like terminal, wherein a molded waterproof part that prevents water intrusion from a periphery of the electric wire is integrally molded at least around the periphery of the electric wire, wherein the electric wire that includes the molded waterproof part is integrally molded with the rear housing, and wherein a regulating engagement part that regulates relative movement with respect to the rear housing is formed on the molded waterproof part.

6. The electrical connector of claim 5, wherein the connection terminal comprises a braided wire.

* * * * *